United States Patent [19]

Zenz et al.

[11] Patent Number: 5,033,413

[45] **Date of Patent: * Jul. 23, 1991**

[54] FLUIDIZED BED COMBUSTION SYSTEM AND METHOD UTILIZING CAPPED DUAL-SIDED CONTACT UNITS

[75] Inventors: Frederick A. Zenz, Garrison, N.Y.; James J. Colyar, Newtown, Pa.; Allen S. Li, Morristown, N.J.

[73] Assignee: HRI, Inc., Princeton, N.J.

[ * ] Notice: The portion of the term of this patent subsequent to Aug. 14, 2007 has been disclaimed.

[21] Appl. No.: 547,561

[22] Filed: Jul. 2, 1990

Related U.S. Application Data

[63] Continuation-in-part of Ser. No. 348,848, May 8, 1989, Pat. No. 4,947,803.

[51] Int. Cl.[5] ..... B09B 3/00; F22B 1/00

[52] U.S. Cl. ..... 122/4 D; 110/245; 110/345; 165/104.16

[58] Field of Search ..... 122/4 D; 110/245, 345; 431/7, 170; 165/104.16; 422/146

[56] References Cited

U.S. PATENT DOCUMENTS

| | | | |
|---|---|---|---|
| 4,211,186 | 7/1980 | Pearce | 122/4 D |
| 4,409,926 | 10/1983 | Moore | 122/4 D |
| 4,770,237 | 9/1988 | Morin et al. | 165/104.16 |
| 4,879,958 | 11/1989 | Allen et al. | 110/245 |

*Primary Examiner*—Edward G. Favors
*Attorney, Agent, or Firm*—Fred A. Wilson

[57] ABSTRACT

A fluidized bed combustion system and method for combusting particulate fuel such as coal together with a sorbent material such as limestone to heat a pressurized liquid and generate saturated vapor, such as steam. The combustion system utilizes at least one concentric dual-sided riser-downcomer unit having a central riser passageway and a concentric outer downcomer passageway located above a dense phase fluidized bed in an enclosure module, the downcomer being configured for directing particulate solids back to the bed. The unit inner and outer passageway surfaces each include a heat exchange panel containing the pressurized liquid for absorbing heat from combustion of the fuel and generating the vapor such as pressurized steam. Primary air is provided below the fluidized bed, while secondary air is provided into the riser passageway. The coal feed particles are substantially completely combusted during their passage through the circulating loop passages, and flue gas is passed outwardly through a cyclone separator, from which any unburned solids are returned to the fluidized bed. The resulting ash and spent limestone are withdrawn from the lower portion of the fluidized bed. Pressurized saturated steam is withdrawn from the unit, while particulates are removed from the flue gas.

22 Claims, 4 Drawing Sheets

FLUIDIZED BED COMBUSTION SYSTEM AND METHOD UTILIZING CAPPED DUAL-SIDED CONTACT UNITS

BACKGROUND OF INVENTION

This is a continuation-in-part application of Ser. No. 07/348,848, filed May 8, 1989 U.S. Pat. No. 4,947,803.

This invention pertains to a fluidized bed combustion system utilizing a riser-downcomer unit having dual-sided heat absorbing walls used in combination with a fluidized bed of particulate fuel solids for heating liquids and generating vapors. It pertains particularly to such a combustion system and method utilizing multiple dual-sided concentric riser-downcomer units each provided in a module for burning fluidized circulating particulate fuels such as coal together with limestone to heat feed water and generate pressurized saturated liquid or steam.

The use of fluidized combustion beds has been recognized as an advantageous way of generating heat from particulate fuels, such as by use of heat exchanger tubes in boilers in which pressurized steam is generated from feed water passing in heat exchange relation with hot combustion gases from the fluidized combustion bed. The fluidized bed burns a particulate carbonaceous fuel such as coal, and is fluidized by passing; air upwardly through the fuel to provide its combustion. Advantages for such fluidized bed combustion systems include increased heat transfer rates, reduction in boiler fouling and corrosion, increase in combustion efficiency, and reduction in boiler size.

Some similar configurations of gas-solids contactors having concentric flow arrangements are known, such as U.S. Pat. No. 3,826,738 to Zenz, which discloses a concentric folded transfer line reactor for circulating particulate materials for fluidized catalytic cracking (FCC) units. However, such concentric folded riser-downcomer configurations apparently have not been previously used for fluidized bed combustion of particulate fuels such as coal for generating saturated vapors such as steam. Some other types of fluidized bed combustors include, for example, U.S. Pat. No. 3,910,235 to Highley which discloses a fluidized bed combustion apparatus utilizing internally circulating beds each surrounded by a heat exchange jacket. Also, U.S. Pat. No. 4,240,377 to Johnson discloses a fluidized bed compact tubular boiler utilizing circulating solids, and U.S. Pat. No. 4,539,939 to Johnson discloses fluidized bed combustion tubular boiler apparatus for combusting coal with limestone to generate steam.

These prior fluidized bed combustion boiler systems use a different solids flow configuration and have been found to be undesirably complicated and difficult to control and are also undesirably expensive. Such disadvantages of prior art fluidized bed combustion boilers and systems have now been advantageously overcome by the present invention, which provides an improved fluidized bed combustion system and method which utilizes at least one central riser and concentric donwcomer unit having dual-sided heat exchange surfaces located above a fluidized bed in an enclosure or module for combusting particulate fuels such as coal to generate pressurized steam.

SUMMARY OF INVENTION

The present invention provides an improved fluidized bed combustor system and method for heating liquids and generating vapors, and which operates at relatively low combustion temperatures but provides high heat transfer efficiency to the liquid. The invention utilizes at least one circulating solids loop for fluidized bed particles in at least one dual-sided concentric riser-downcomer unit located above the fluidized bed and adapted for burning a fluidized particulate fuel such as coal, together with a particulate sorbent material such as limestone, in the fluidized bed and during their passage through the unit. The combustor unit includes a capped central riser passageway flow connected to a concentric outer downcomer passageway located above the dense phase fluidized bed, so as to provide a continuous folded passageway for continuous circulating flow of dilute phase particulate solids and combustion gases therethrough from the bed. In the folded passageways, the cross-sectional area is selected and flow velocity is controlled together with the combustible particle temperature and residence time, so that the fuel particles from the fluidized bed are substantially completely combusted during their passage through the downcomer passageway portion of the riser-downcomer unit above the fluidized bed.

The capped central riser and concentric downcomer passageways of each unit are formed by four concentric tubes which are sealed together at each end to form inner and outer walls defining intervening channels or compartments therebetween to provide dual heat exchanger panels, which are liquid filled. The particulate coal and limestone are continuously entrained from the dense phase fluidized bed upwardly in dilute phase through the central riser passageway by upflowing secondary air stream injected therein. Heat transfer occurs predominantly by convection and radiation from the flowing gas-solids to the exposed walls of the riser-downcomer unit and to the liquid contained in the dual compartments therein. The downcomer exit is configured for effective separation of the entraining combustion gas from the downflowing particulate solids above the fluidized bed, so that the solids are effectively returned to the bed for recirculation through the riser-downcomer unit for further combustion. Such recirculation of particulate solids back to the fluidized bed may be effectively facilitated by a cylindrical skirt located radially outwardly from the downcomer passageway exit, with the skirt having its lower portion immersed in the fluidized bed.

The combustor fluidized bed and riser-downcomer unit are enclosed within a casing so as to provide a module, which incorporates a plenum and an inlet flow distributor below the fluidized bed for primary air supply. The flow distributor provides low pressure drop and uniformly distributes the primary air flow upwardly through the shallow fluidized bed of coal, limestone and combustion products.

The capped riser-downcomer unit embodies the concept of unburned particle separation by particle impingement in the fluidized bed, and utilizes an increased gas velocity in the riser passageway compared to the downcomer passageway. In general, the upward superficial gas velocity in the central riser passageway should exceed the terminal or free fall velocity of the largest particle desired to be conveyed vertically upward, while the downwardly flowing superficial gas velocity in the outer downcomer passageway could in the extreme be only a function of the terminal or free fall velocity of the smallest size particle being circulated.

The cross-sectional area of the annular-shaped outer downcomer passageway usually exceeds that of the central riser passageway by an area ratio in the range of 1.5:1 to 4:1, thus providing for reduced particle velocity and increased particle residence time in the downcomer passageway for achieving substantially complete combustion of the fuel particles with the gases therein. The upward superficial air velocity in the dense phase fluidized bed should be about 5–12 ft/sec. The superficial gas velocity in the riser central passageway must be sufficient for entraining particles upwardly from the fluidized bed, and usually is increased to 12–35 ft/sec, and the superficial gas velocity in the larger area outer downcomer passageway is usually reduced to 6–20 ft/sec.

The total cross-sectional area of the fluidized bed should exceed that of the downcomer outermost tubular wall by an area ratio in the range of 1.5:1 to 4:1. The configuration of each capped riser-downcomer unit will depend on its desired performance. The unit height and diameter are determined by the desired contact or residence time and throughput for the particulate solids, with the ratio of height to outer diameter being at least about 8:1 and usually not exceeding about 20:1.

The vertical distance between the downcomer exit and the fluidized bed upper level should be at least equal to the radial width of the downcomer passage, and usually should not exceed about two times such radial width. The circulating solids flow rate through the riser-downcomer unit exceeds the fresh coal and limestone feed rate into the fluidized bed by a ratio of at least about 2:1, and usually not exceeding a 4:1 ratio. Temperature rises across the folded flow passageways of the riser-downcomer unit can be as small as 50° F. and as great as 500° F. The fluidized bed combustion unit is designed for improved performance, as well as ease of fabrication, installation, cleaning, and maintenance.

Dimensions of each capped riser-downcomer unit are related to its desired performance, for example the riser-downcomer unit height may be based on providing sufficient residence time for complete combustion of an average 500 micron size coal particle. The downcomer passage cross-sectional area exceeds that of the riser passage, and the fluidized bed upper level is usually maintained below the downcomer exit by a distance equal to 0.7–5 times the downcomer passage radial width. Also, the total cross-sectional area of the fluidized bed exceeds that of the outermost wall of the downcomer. Use of the high velocity particle recirculating loop reduces bed height, greatly improves heat transfer by dual-sided exposure to high velocity combusting coal solids, and reduces particle entrainment from the fluidized bed and reduces the downward velocity of unburned particles for return to the bed by impingement thereon.

This invention also provides a method for combusting particulate fuel such as coal together with a particulate sorbate material such as limestone in a dense phase fluidized bed located below a dual-sided concentric capped riser-downcomer unit, having an inner riser passageway and a concentric outer downcomer passageway. Particulate fuels which can be burned include coal, coke and oil shales having particle size of 100 micron to 0.50 inch. Coals which contain sulfur can be burned together with a sorbate material such as limestone to absorb the sulfur released from the coal during its combustion. If desired, the particulate fuel and sorbate material can be advantageously fed into the fluidized bed as a coal-limestone-water slurry.

This invention advantageously provides a compact and efficient combustion system and a method for burning particulate fuels such as coal together with a sorbate material such as limestone in a circulating water-walled loop to produce heat used for vaporizing a liquid to generate vapor, such as heating pressurized water to generate saturated steam. The combustion system is designed to minimize producing nitrogen oxides and sulfur oxides and for substantially removing particulates from the resulting flue gases. Desired percentage turndowns for the system can be provided by variation of the fuel solids feed rate to all the riser-downcomer units, or by shutting down feed of solids and gas to one or more units. This fluidized bed combustion system and method is also useful for combusting particulate waste materials which are combustible or contain combustible constituents, such as municipal wastes and sludges.

BRIEF DESCRIPTION OF DRAWINGS

The invention will be further described with reference to the following drawings, in which.

Figure 3:
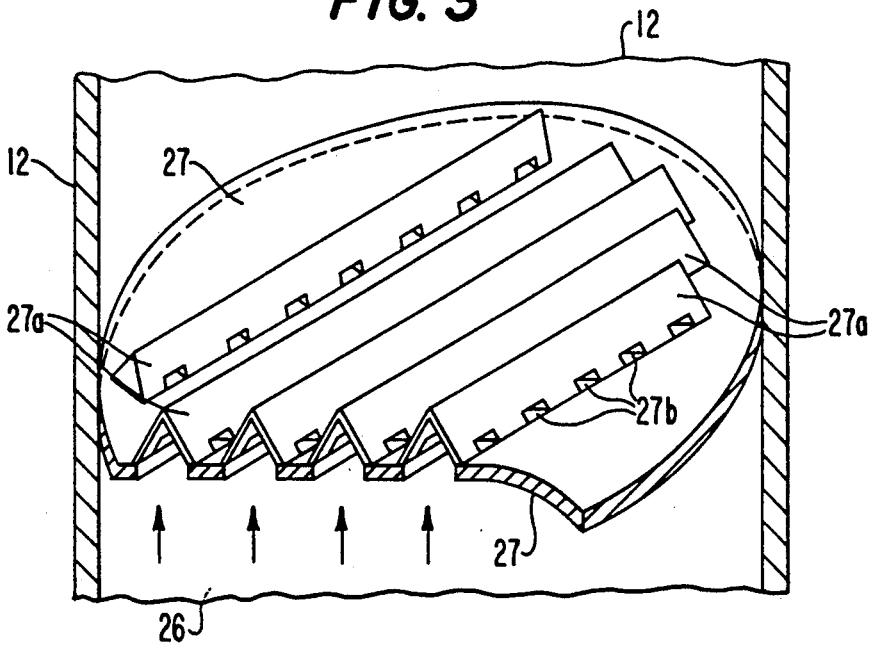
Figure 4:
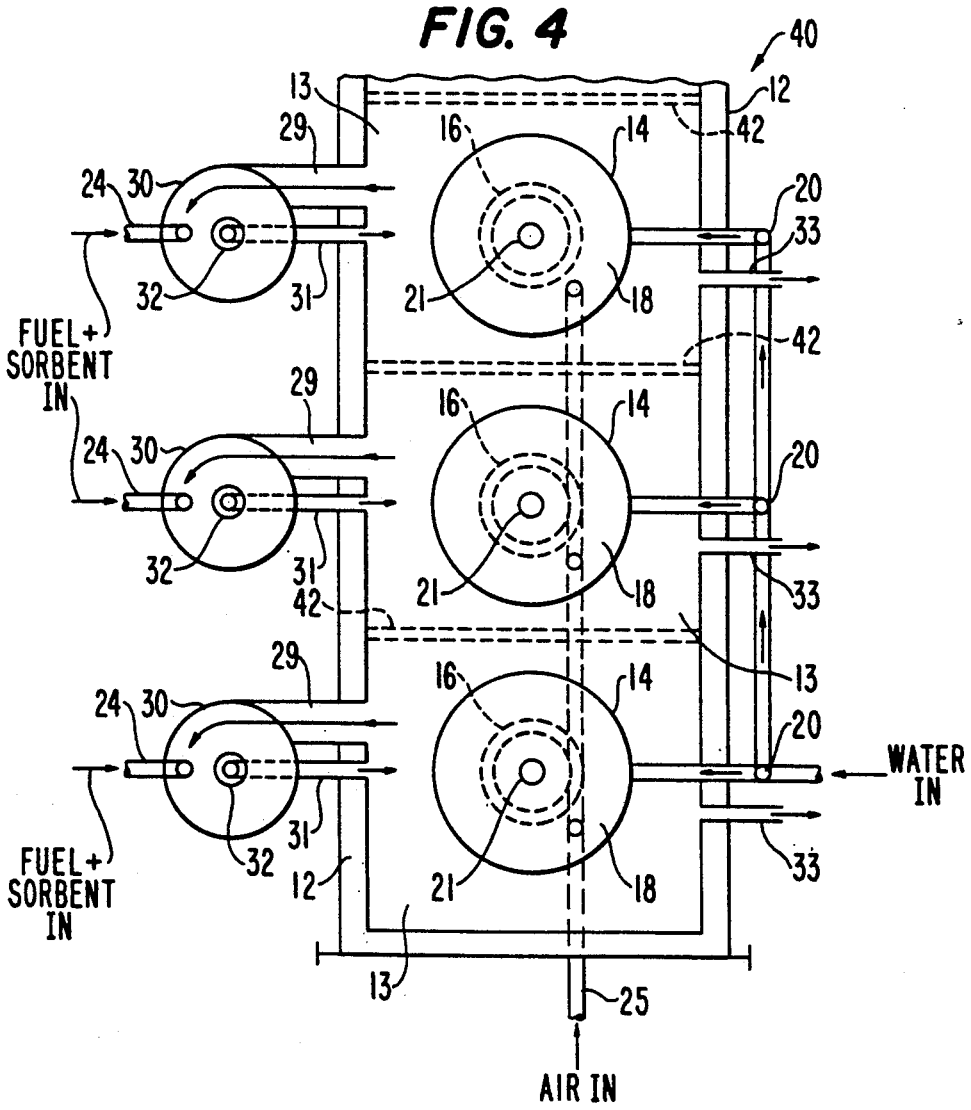
Figure 5:
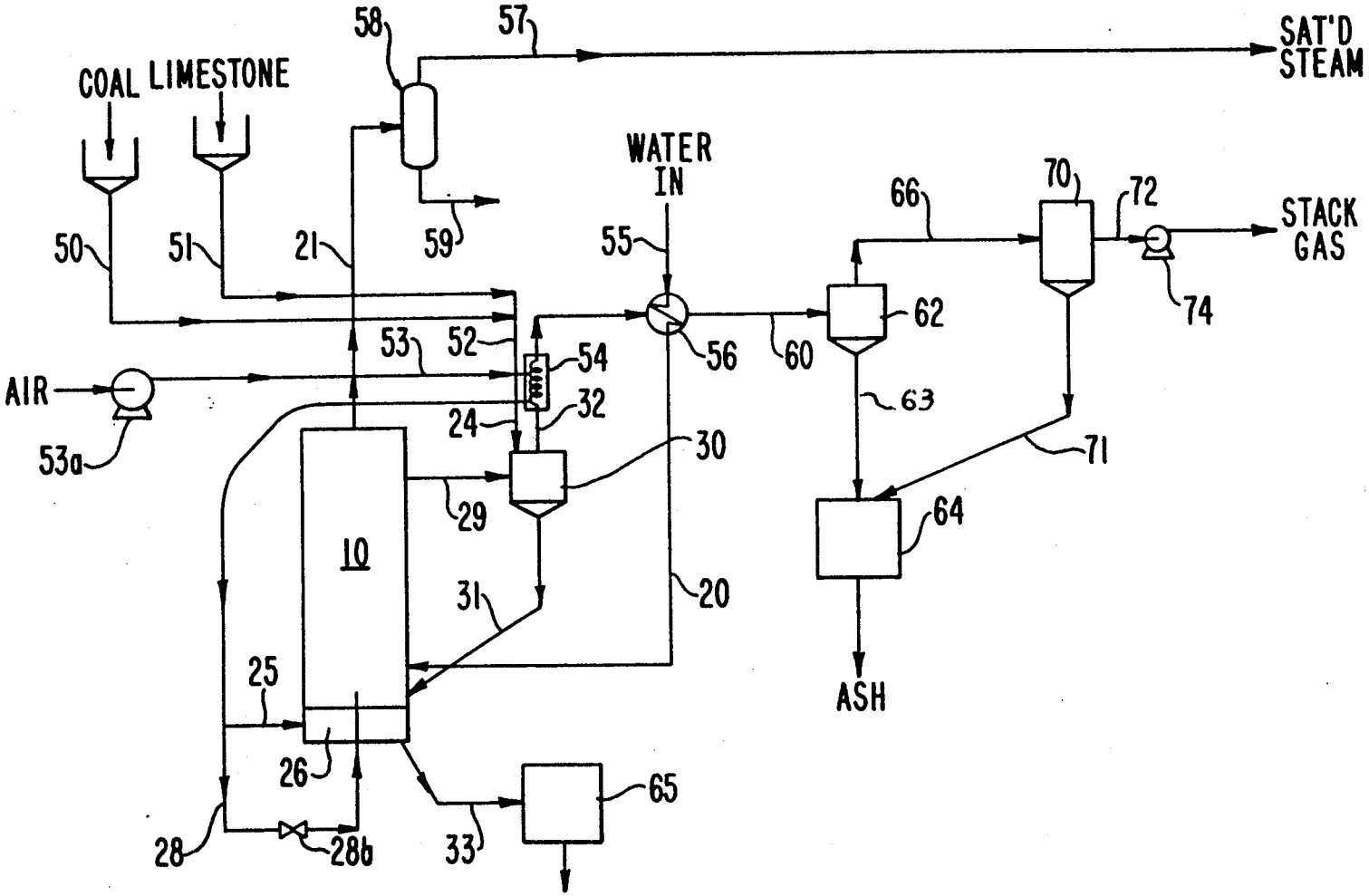

FIGS. *2a* & *2b* show a schematic view of alternative configurations for the lower portion of the riser-downcomer unit passageway relative to the fluidized bed;

FIG. 3 shows a partial perspective view of a tunnel cap grid device for flow distribution of primary air upwardly into the fluidized bed;

FIG. 4 shows a combustion system module assembly including multiple combustor modules each aligned in an in-line parallel arrangement; and FIG. 5 is a schematic flow diagram of a fluidized bed fuel combustion system according to the invention, showing the method for operation of the system.

DESCRIPTION OF INVENTION

Figure 1:
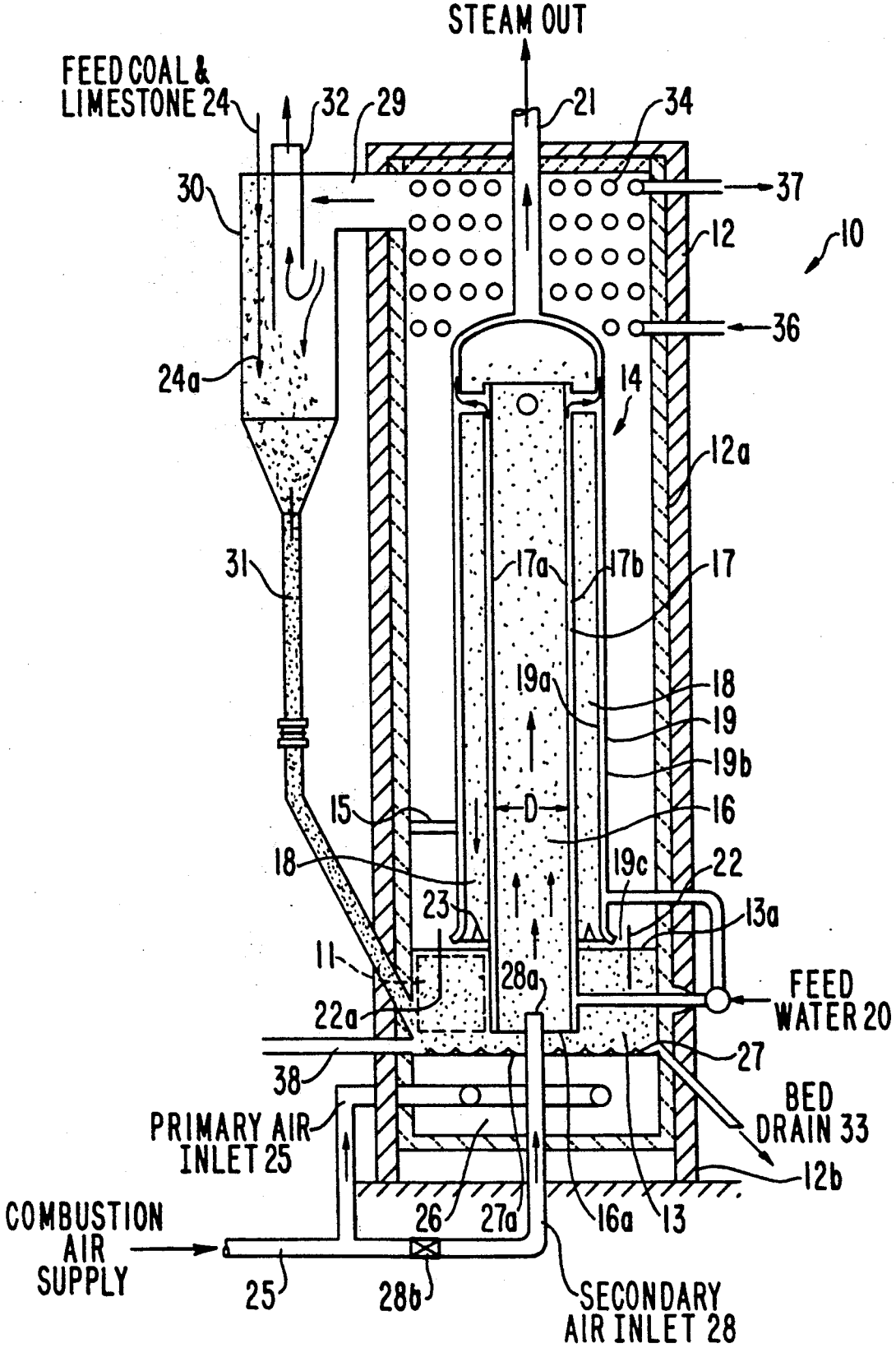
FIG. 1 shows a combustion system module including a fluidized bed provided below a riser-downcomer unit having an inner riser passageway joined at its upper end to a concentric outer downcomer passageway within a housing.

A schematic view of a single reactor module including a dual sided fluidized bed circulating solids combustion unit is generally shown in FIG. 1. The module 10 consists of an enclosing casing or vessel 12 in which a shallow dense phase fluidized bed 13 of fuel particles such as coal and a sorbent material such as limestone is provided in the casing lower portion. A riser-downcomer unit 14 including a central capped riser passageway 16 and concentric downcomer passageway 18 is centrally located and supported within the module 10, which usually has a rectangular-shaped casing 12 which is thermally insulated by refractory lining 12*a* to minimize heat loss. The riser and downcomer passages are completely water-walled on both sides by inner compartment 17 and outer compartment 19, for substantial heat absorption by convection and radiation from the gases and burning fuel particles flowing through the passages, with only limited heat removal being provided directly from the shallow fluidized bed 13. An access door 11 is usually provided in the lower portion of casing 12, which rests on support means 12*b*.

The riser-downcomer unit water-walled compartments 17 and 19 are each formed by two concentric pipes, with inner compartment 17 being contained between the inner two walls 17*a* and 17*b*, and outer compartment 19 being contained between the outer two walls 19*a* and 19*b*. Pressurized feed water at a selected pressure such as about 200 psig is introduced at 20 into the lower end of each compartment 17 and 19 in which the water is heated, and pressurized saturated steam is withdrawn from the upper end of the riser-downcomer unit 14 at conduit 21. The riser-downcomer unit 14 can be supported within vessel 12 by conduit 21, and is stabilized laterally at its lower end by one or more lateral supports 15 extending radially to the inner wall of vessel 12.

The downcomer passageway exit zone 19*c* is configured to provide effective separation of downflowing uncombusted fuel solids from the entraining gas and for directing the downflowing solids back into the fluidized bed 13 for return to the mouth 16*a* of riser passageway 16, so as to promote solids recycle through the riser-downcomer unit 14. To help assure such recycle of particulate fuel solids to the fluidized bed, a cylindrical baffle 22 is preferably provided and located radially outwardly from downcomer exit 19*c* at a location intermediate the exit and the vessel 12 inner wall, with the baffle lower portion 22*a* being immersed within upper level 13*a* of the fluidized bed 13. The radial distance or spacing between the downcomer 19 exit and baffle 22 should be 1–2 times the maximum radial width of downcomer passageway 19, so as to provide a gas velocity within the cylindrical baffle 22 which is less than that in downcomer passageway 19. Also if desired, a plurality of vertical serrations or slots 23 can be provided circumferentially spaced apart around the lower end of passageway 19 outer wall 19*b* to facilitate the escape of gas radially outwardly and upwardly from the particulate solids downflowing in downcomer passageway 18 back to the fluidized bed 13.

Figure 2A:
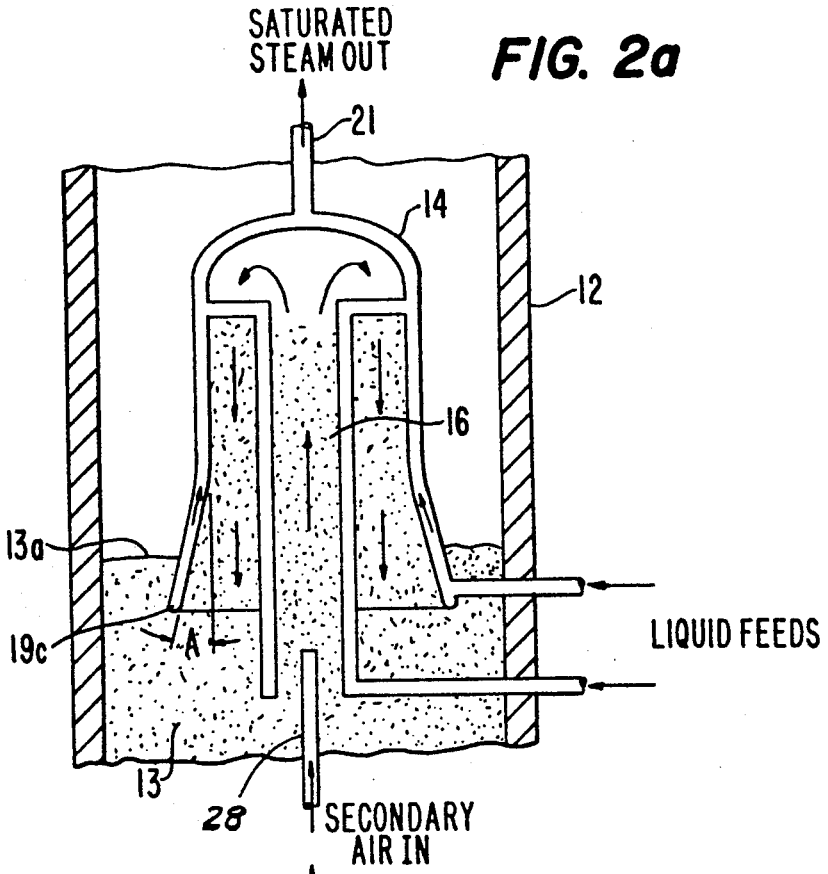

FIG. 2 shows two alternative configurations for the downcomer passageway exit zone 19*c* relative to upper level 13*a* of the fluidized bed 13. In FIG. 2(*a*) the fluidized bed upper level 13*a* is located above the lower end of the downcomer exit 19*c*. The lower portion of outer wall 19 can be flared outwardly by an angle A of 0°–45° with a vertical plane, so as to reduce downward gas velocity and facilitate separation of the downflowing gas from the particulate solids. Also if desired, substantially the entire outer wall 19*b* can be tapered outwardly and used in combination with the cylindrical baffle 22, as shown by FIG. 2(*b*).

Figure 2B:
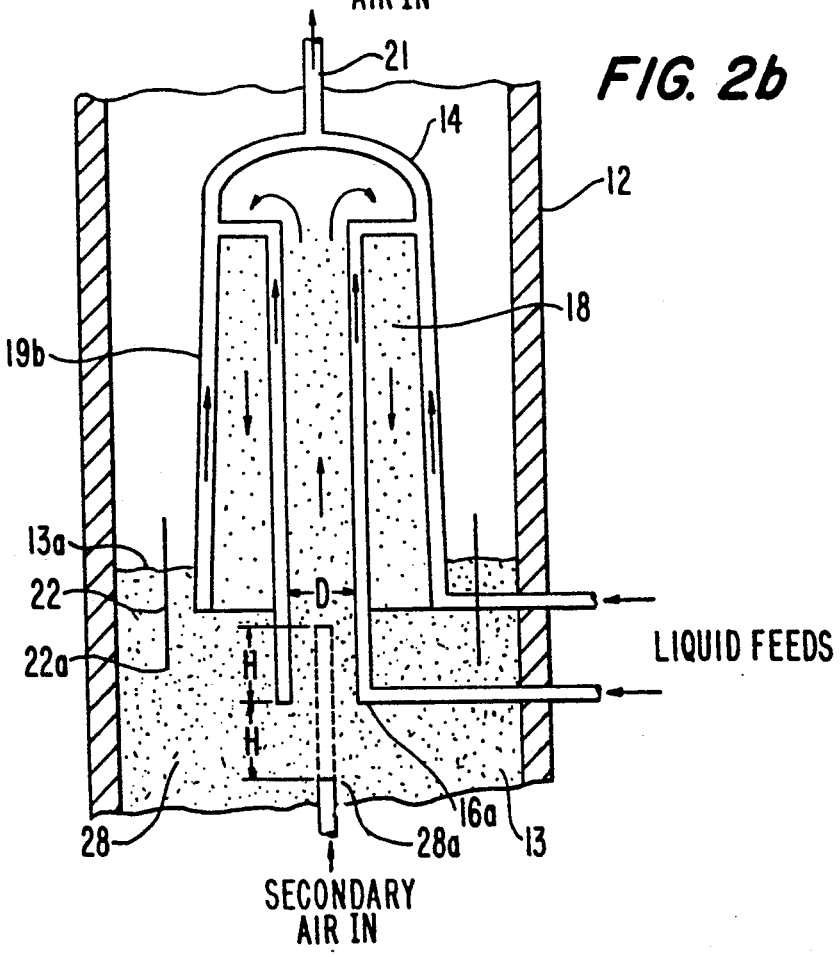

Each module 10 is provided with a single riser-downcomer unit 14, a feed conduit 24 for the coal and limestone, a primary air supply 25 from plenum 26 upwardly through a flow distributor grid 27 into the fluidized bed 13. A secondary air supply 28 is provided and pressure is controlled at valve 28*a* into riser passageway 16. It has been found that to assure effective circulation of the particulate solids upwardly from fluidized bed 13 through the riser and downcomer passageways, the secondary air supply conduit 28 can be located either above or below the lower end 16*a* of the riser passageway 16 by a distance H as shown by FIG. 2*b*, which should not exceed 4.0 times the inside diameter D of the riser passageway 16. The tip end 28*a* should preferably be located below the riser passageway inlet 16*a* by a distance equal to 0.5–3 the riser inside diameter D. Hot combustion gas arising from fluidized bed 13 is passed upwardly around the riser-downcomer unit 14 in contact with outer wall 19*b* of compartment 19 and out through upper outlet 29 to a primary cyclone separator 30 for providing gas-solids separation from the gases, which exit at conduit 32. The feed nozzle 24*a* and internal baffles in the cyclone separator 30 are configured so that fresh coal and limestone dust losses from the cyclone into conduit 32 are substantially eliminated.

In the cyclone 30, the cold particulate solid feed material at 24 is contacted with hot 1000° F. flue gas arising from the fluidized bed 13 in passageway 29, and rapidly heats the solids to above about 900° F. before they enter the fluidized bed 13 of the combustor via the cyclone dipleg conduit 31. Primary combustion air at 25 is introduced into the reactor plenum 26 and is distributed uniformly upwardly into the fluidized bed 13 by the apertured grid 27. The grid 27 can be a perforated plate, or may advantageously consist of a plate 27 having slots covered by pieces of inverted metal angle stock 27*a* with openings 27*b* formed generally horizontally therein, as generally shown in FIG. 3. Secondary air at 28 is injected into the lower end of the central riser passageway 16 and transports the particulate solids material from the fluidized bed 13 upwardly in the riser passageway, and also provides oxygen needed for combustion of the fuel in the continuous riser and downcomer passages. Also, a bed drain conduit 33 is provided for withdrawing ash and spent limestone from the fluidized bed 13. The bed drain 33 is usually located as far as possible from the cyclone dipleg 31 feed entry, so as to minimize any losses of fresh coal and limestone from the fluidized bed 13.

If desired, additional saturated steam can be produced in a convection coil or tubes 34 which can be located in the vessel 12 freeboard zone above the riser-downcomer unit 14. Pressurized water is introduced into the coil 34 at inlet connection 36 and saturated steam is withdrawn at outlet 37. Combustion of the particulate fuel in fluidized bed 13 is usually initiated by a start-up burner 38 fueled by gas or oil.

Each combustion module 10 is preferably arranged to be individually shop fabricated, and can be advantageously joined with other adjacent rectangular-shaped modules into an assembly 40, as generally shown by FIG. 4. Each module can be conveniently sized for producing about 10,000 lb/hr of pressurized saturated steam. Multiple modules of up to five modules 10 can be advantageously used for a commercial size 50,000 lb/hr steam generating facility.

A plan view of fluidized bed combustor assembly 40 utilizing up to five combustor modules 10 is shown by FIG. 4, which includes three square modules 10 arranged in parallel alignment with plenum separation walls 42 being provided between the adjacent modules 10. The inside width dimension of each fluidized bed 13 in casing 12 should exceed the outer diameter of each riser-downcomer unit 14 by a ratio of 1.5:1 to 2:1. A separate isolated plenum 26 is provided for primary air 25 supplied to each combustor module 10, thereby allowing different fluidization velocities to be established for the fluidized bed 13 in each module as desired. A gas-solids cyclone separator 30 is provided connected via conduit 29 for each module 10, the separators being located along one side of the combustor assembly 40. The feedstreams 24 of coal and limestone solids to each module 10 enter at the top of each cyclone separator 30, as previously described for the FIG. 1 module configuration. The primary and secondary combustion air streams as well as water inlet 20 to each module 10 are provided along the side of combustor assembly 40 opposite the cyclone separators 30, and pressurized steam is withdrawn at conduit 21 from the top of each module into a common delivery conduit (not shown). Variation in steam output from the entire fluidized bed combustion assembly 40 can be achieved either by shutting down one or more of the modules 10, or by varying the feed rates for coal, limestone, air and water substantially equally to each module.

For operation of the fluidized bed combustion system, as shown by the FIG. 5 flow diagram, crushed coal is provided at 50 and crushed limestone is provided at 51, and each are fed by air entrainment from storage bins to each module 10 via a conduit 52. The crushed coal and limestone each have particle size of 400–600 microns, and are fed into the primary cyclone 30 at nozzle 24 adjacent hot gas outlet 32. The single coal and limestone feed entry via the primary cyclone dipleg conduit 31 is oriented so as to feed the fuel and limestone solids into the fluidized bed 13. Operation of the fuel combustion in bed 13 is usually initiated by a start-up gas-fired burner 38 directed into the fluidized fuel bed 13.

If desired, hot flue gas stream exiting from cyclone 30 at conduit 32 may be cooled such as to about 350° F. at heat exchanger 54 against combustion air supply 53 from blower 53*a*. Also if desired, the flue gas at conduit 32 can be further cooled at exchanger 56 against cold pressurized feed water provided at conduits 55 and 20 to the heat exchanger panels 17 and 19, with the feed water being heated to near its saturation temperature. Also if desired, heat from the fluidized bed solids drain 33 ca be used to preheat the primary air 25 and/or secondary air 28 to plenum 26 of the combustor module 10.

Pressurized saturated steam is withdrawn from each module 10 at conduit 21, and is usually passed to a blowdown drum 58 for removal of saturated steam at conduit 57 and any condensate at drain 59. The cooled flue gas at 60 is passed to a secondary cyclone separator 62, where any remaining particulate solids are removed at 63 and passed to an ash collection bin 64. The resulting cleaned flue gas at 66 is passed to a bag type filter unit 70 to remove any remaining fine particulates, which are withdrawn at drain 71 to the collection bin 64. The cleaned stack gas leaves the filter unit 70 at 72 via draft fan 74.

As an alternative fuel feeding arrangement, the particulate coal and limestone can be conveniently fed to the fluidized bed 13 as a coal-limestone-water slurry stream. The slurry is advantageously fed at nozzle 24 into an enlarged gas-solids separator 30 which is designed to remove a significant portion of the water as vapor before introducing the remaining fuel solids and water into the fluidized bed 13. It is desirable to remove as much water as possible from the slurry feed upstream of the fluidized bed 13.

This invention will be further described by the following example, which should not be construed as limiting the scope of the invention.

EXAMPLE

A typical fluidized bed combustion system consists of five modules each containing a fluidized bed of fuel particles and a riser-downcomer unit, which are rated at 10,000 lb/hr of steam capacity. Crushed coal and limestone are fed into each module adjacent the primary cyclone gas outlet for preheating the feed material before it enters the shallow fluidized bed via the cyclone dipleg conduit. Primary air is distributed from the plenum uniformly upwardly into the fluidized bed through an apertured grid. Secondary air is injected upwardly into the riser passage at velocity sufficient to convey coal and limestone particles upwardly in the riser and to promote further complete combustion of the coal feed via recycle of particles. The riser and downcomer passageways are formed by four concentric pipes which provide inner and outer compartments each filled with pressurized feed water to generate saturated steam. Additional steam is produced by water fed into a convection coil located in the module above the riser-downcomer unit and the fluidized bed.

Important construction characteristics and operating parameters for each module of the fluidized bed combustion system are provided in Table 1 below.

TABLE 1

| | |
|---|---|
| Fluidized Bed height, ft. | 4 |
| Riser passageway height, ft. | 20 |
| Downcomer passageway height, ft. | 18 |
| Superficial gas velocity in fluidized bed, ft/sec | 10 |
| Feed water pressure, psig | 200 |
| Feed water temperature, °F. | 388 |
| Fluidized Bed temperature, °F. | 1500 |
| Superficial gas velocity in riser, ft/sec | 30 |
| Superficial gas velocity in downcomer, ft/sec | 15 |
| Height of downcomer exit above fluidized bed upper level, ft. | 1.5 |
| Flue gas exit temp., °F. | 350 |
| Fluidized bed particle size, microns | 300–600 |

The resulting flue gases are passed through both primary and secondary separators for removal of particulate solids, which are recycled back to the fluidized bed, while ash and spent limestone solids are withdrawn from the fluidized bed lower portion.

Although this invention has been described broadly and in terms of certain preferred embodiments, it will be understood that modifications and variations can be made and that some features can be used without others all within the spirit and scope of the invention, which is defined by the following claims.

We claim:

1. A fluidized bed combustion and heat transfer system for heating a liquid and generating saturated vapor, comprising:

(a) a vessel having a combustion chamber provided in the vessel lower portion and containing a dense phase fluidized bed of particulate combustible fuel material;

(b) means for feeding a particulate fuel material into the fluidized bed in the combustion chamber;

(c) a riser-downcomer unit having a central riser passageway flow connected to a concentric outer downcomer passageway, said unit extending substantially vertically within said combustion vessel, with the downcomer passageway exit being located near the upper level of the fluidized bed and being configured for directing downflowing particulate solids from the downcomer passageway back to the fluidized bed, said riser-downcomer unit including dual concentric compartments each forming heat exchange panel means, said panel means containing dual liquid flow passages therein;

(d) distributor means for feeding primary air upwardly into the fluidized bed, and including means for introducing secondary air upwardly into the central riser passageway;

(e) means for feeding a liquid into a lower portion of said heat exchange panel, and including vapor withdrawal means provided at the upper end of said panel; and (f) a cyclone separator flow connected to the vessel upper end portion for outward passage of combustion gases and entrained solids therethrough, whereby a particulate fuel can be fed into the fluidized bed and circulated in dilute phase with combustion gases through the riser-downcomer unit passageways in heat exchange relation with the panel walls and the fuel combusted during passage through said unit, so as to produce flue gases and to heat and vaporize a liquid contained in the heat exchange panel compartments, and particulate solids collected in the cyclone separator can be recycled from the cyclone separator back to the fluidized bed.

2. A combustion system according to claim 1, wherein a cylindrical-shaped baffle is provided spaced outwardly from said downcomer passageway exit for directing the downflowing particulate solids back to the fluidized bed.

3. A combustion system according to claim 1, wherein said distributor means includes a plurality of flow conduits having openings which are oriented substantially horizontally for supplying the primary gas into said fluidized bed.

4. A combustion system according to claim 1, wherein the downcomer passageway has cross-sectional area exceeding that of the riser passageway by a ratio within a range of 1.5:1 to 4.0:1.

5. A combustion system according to claim 1, wherein the fluidized bed upper level is maintained below the downcomer passageway outlet by a distance equal to 0.75–5 times the radial width of the downcomer passageway.

6. A combustion system according to claim 1, wherein the particulate solids feeding means is arranged in heat exchange relation with flue gases passing outwardly through said cyclone separator, so that the feed solids are combined with solid particles recycled from said cyclone separator back to the fluidized bed.

7. A combustion system according to claim 1, including means for solids withdrawal from the lower portion of the fluidized bed in heat exchange relation with the feed liquid.

8. A combustion system according to claim 1, wherein tubes containing additional liquid are provided in the upper portion of said vessel above said riser-downcomer unit so as to heat and vaporize the additional liquid.

9. A combustion system according to claim 1, wherein said vessel containing the fluidized bed has inside width dimension exceeding the outer diameter of said riser-downcomer unit by a ratio of 1.5:1 to 3:1.

10. A combustion system according to claim 1, wherein said means for introducing secondary air into said riser passageway is located below the passageway by a distance equal to 0.5–3 times the riser passageway inside diameter.

11. A combustion system according to claim 1, wherein a plurality of rectangular-shaped modules each containing a riser-downcomer unit are provided in adjacent alignment to form a combustion module assembly, and the spacing between the riser-downcomer units in said adjacent modules is 1.5–2.5 times the riser-downcomer unit outer diameter.

12. A fluidized bed combustion and heat transfer system for heating a liquid generating saturated vapor, comprising:

(a) a vessel having a combustion chamber provided in the vessel lower portion and containing a dense phase fluidized bed of particulate combustible fuel material;

(b) means for feeding particulate fuel materials into the fluidized bed in the combustion chamber;

(c) a plurality of modules each including a riser-downcomer unit having a central riser passageway flow connected to a concentric outer downcomer passageway extended substantially vertically within said combustion vessel, with the downcomer passageway exit being configured for directing downflowing particulate solids from the downcomer passageway back to the fluidized bed, and being located above the upper level of the fluidized bed;

(d) heat exchange panel means attached to the walls of said riser-downcomer unit, said panel means containing liquid flow passages therein;

(e) distributor means for feeding primary air upwardly into the fluidized bed, and including means for introducing secondary air upwardly into the central riser passageway at a velocity sufficient to convey particulate solids through the riser-downcomer unit;

(f) means for feeding a liquid into a lower portion of said heat exchanger panel means, and including vapor withdrawal means provided at the upper end of said panel means; and (g) a cyclone separator located adjacent said combustor vessel for each module and flow connected to the vessel upper end portion for outward passage of combustion gases and entrained solids therethrough, whereby a particulate fuel can be fed into the fluidized bed and circulated in dilute phase with combustion gases through passageways of the riser-downcomer unit in heat exchange relation with the panel walls and the fuel combusted during passage through each said unit, so as to produce flue gases and to heat and vaporize the liquid contained in the heat exchange panel compartments, and particulate solids collected in the cyclone separator can be recycled from the cyclone separator downwardly back to the fluidized bed.

13. A method for combusting a particulate fuel in a fluidized bed combustion chamber to generate vapor, comprising the steps of:

(a) feeding particulate fuel solids into a dense phase fluidized bed located in a vessel and below at least on riser-downcomer unit having a central riser passageway and a concentric outer downcomer passageway;

(b) feeding primary combustion air upwardly into the fluidized bed at velocity of at least about 10 ft/sec to fluidize the bed, and feeding secondary air upwardly into the riser passageway at a velocity of 15–25 ft/sec to entrain particles from the fluidized bed upwardly into the riser passageway;

(c) feeding a vaporizable liquid into the lower end of a dual sided heat exchanger panel attached to said riser-downcomer unit;

(d) continuously passing a portion of the particulate fuel in dilute phase upwardly from said dense phase fluidized bed through said central riser passageway, and then downwardly through said concentric outer passageway back to the fluidized bed at a particle flow rate so as to substantially completely combust and gasify the particulate fuel; and (e) heating and vaporizing the liquid in said riser-downcomer unit to generate vapor, and withdrawing the vapor from the upper portion of the heat exchanger panel.

14. A vapor generating method according to claim 13, wherein the superficial upward gas velocity within the riser passageway is 15–25 ft/sec and the superficial gas velocity within the downcomer passageway is 5–15 ft/sec.

15. A vapor generating method according to claim 13, wherein the recycle ratio of fuel solids circulating through the riser-downcomer passages exceeds the fresh fuel solids feed rate by a ratio of at least 2:1.

16. A vapor generating method according to claim 13, wherein solids exiting the donwcomer passageway are substantially returned to the fluidized bed, and gases are passed to a cyclone gas-solids separator from which particulate solids are returned to the fluidized bed.

17. A vapor generating method according to claim 13, wherein the vaporizable feed liquid is water and the vapor generated is saturated steam.

18. A vapor generating method according to claim 13, wherein the particulate fuel is coal together with particulate limestone sorbent material.

19. A vapor generating method according to claim 13, wherein the particulate fuel is oil shale.

20. A vapor generating method according to claim 13, wherein the combustion air is preheated to at least about 500° F. against the hot flue gas.

21. A vapor generating method according to claim 13, wherein the vaporizable liquid is preheated to at least about 300° F. against the hot flue gas.

22. A method for combusting particulate coal together with limestone in a fluidized bed combustion chamber to generate pressurized steam, comprising the steps of:

(a) feeding particulate coal and limestone into a dense phase fluidized bed located in a vessel and below at least one riser-downcomer unit, each said unit having a central riser passageway and a concentric outer downcomer passageway;

(b) feeding primary combustion air upwardly into the fluidized bed at a velocity of 10–15 ft/sec to fluidize the bed, and feeding secondary air upwardly into the riser passageway at a velocity of 15–25 ft/sec to entrain coal and limestone particles from the fluidized bed upwardly into the riser passageway;

(c) feeding pressurized water into the lower end of a dual sided heat exchange panel attached to said riser-downcomer unit;

(d) continuously passing a portion of the particulate coal and limestone in dilute phase upwardly from said fluidized bed through said central riser passageway at a superficial gas velocity of 15–25 ft/sec and then downwardly through said concentric outer passageway to the fluidized bed at a superficial gas velocity of 5–15 ft/sec, so as to substantially completely combust and gasify the particulate coal;

(e) heating and vaporizing the pressurized water in said riser-downcomer unit heat exchange panel to generate pressurized steam, and withdrawing the steam from the upper portion of the heat exchanger panel; and (f) withdrawing ash and spent limestone from a lower portion of the fluidized bed.

* * * * *